US006026902A

United States Patent [19]

Bingham

[11] Patent Number: 6,026,902

[45] **Date of Patent: *Feb. 22, 2000**

[54] METHOD AND APPARATUS FOR ENHANCING OIL RECOVERY

[76] Inventor: Clarke S. Bingham, 155 Hollywood, Santa Cruz, Calif. 95060

[ * ] Notice: This patent is subject to a terminal disclaimer.

[21] Appl. No.: 09/216,065

[22] Filed: Dec. 18, 1998

Related U.S. Application Data

[63] Continuation-in-part of application No. 08/899,908, Jul. 24, 1997.

[51] Int. Cl.[7] ..... E21B 43/24

[52] U.S. Cl. ..... 166/272.6; 303/90.1; 303/59

[58] Field of Search ..... 166/272.6, 303, 166/90.1, 59, 245, 261, 266, 267, 75.12

[56] References Cited

U.S. PATENT DOCUMENTS

| | | | |
|---|---|---|---|
| 3,084,919 | 4/1963 | Slater | 262/1 |
| 3,327,782 | 6/1967 | Hujsak | 166/11 |
| 3,428,125 | 2/1969 | Parker | 166/248 |
| 3,598,182 | 8/1971 | Justheim | 166/248 |
| 3,766,982 | 10/1973 | Justheim | 166/261 |
| 4,024,912 | 5/1977 | Hamrick | 166/57 |
| 4,141,417 | 2/1979 | Schora et al. | 166/305 R |
| 4,160,479 | 7/1979 | Richardson | 166/267 |
| 4,183,405 | 1/1980 | Magnie | 166/260 |
| 4,199,025 | 4/1980 | Carpenter | 166/248 |
| 4,241,790 | 12/1980 | Magnie | 166/260 |
| 4,463,805 | 8/1984 | Bingham | 166/248 |
| 4,597,441 | 7/1986 | Ware et al. | 166/261 |
| 5,083,613 | 1/1992 | Gregoli et al. | 166/303 X |
| 5,085,274 | 2/1992 | Puri et al. | 166/245 X |
| 5,339,897 | 8/1994 | Leaute | 166/245 |

*Primary Examiner*—Frank S. Tsay
*Attorney, Agent, or Firm*—Marger Johnson & McCollom, P.C.

[57] ABSTRACT

An apparatus and method for enhancing recovery of oil from producing and dormant wells. The invention is embodied in an apparatus in which brine is mixed with a small amount of oil, and then passed through an alternating current flowing between a pair of spaced apart electrodes. The invention is also embodied in a method which shutting in the second well, injecting hydrogen, hot water and steam into the formation via the first well, monitoring formation pressure at the second well until a pressure increase is detected, and recovering fluids including petroleum from said formation via the second well.

30 Claims, 7 Drawing Sheets

METHOD AND APPARATUS FOR ENHANCING OIL RECOVERY

This application is a continuation-in-part of U.S. Ser. No. 08/899,908, filed Jul. 24, 1997.

BACKGROUND OF THE INVENTION

This invention relates to a method and an apparatus for enhancing primary, secondary and tertiary recovery from oil-bearing formations.

Numerous methods for enhancing secondary and tertiary recovery from oil-bearing formations include the step of injecting hydrogen gas into an oil-bearing formation. U.S. Pat. Nos. 4,597,441 to Ware, 4,183,405 to Magnie, 4,141, 417 to Schora et. al., 3,598,182 to Justheim, 3,327,782 to Hujsak, and 3,084,919 to Slator each disclose methods for injecting hydrogen to achieve in-situ hydrogenation and thereby enhance the recovery additional hydrocarbon values from a deposit. U.S. Pat. No. 4,024,912 to Hamrick et. al., teaches a relatively complex hydrogen generating process which includes combustion of hydrocarbons in an oxygen-lean atmosphere to produce a mixture of carbon monoxide and free hydrogen, which is then reacted with water in the presence of an iron catalyst, thereby converting the carbon monoxide to carbon dioxide and generating additional hydrogen. The carbon dioxide is, then condensed from the mixture, leaving a relatively pure hydrogen gas which can be injected into an oil-bearing deposit according to known methods.

SUMMARY OF THE INVENTION

The present invention provides a simple and efficient apparatus and method for generating a hydrogen-containing brine mixture for use in the recovery of secondary and tertiary values from oil-bearing deposits. In another embodiment of the invention, a method is provided for injecting a hydrogen-containing mixture of brine and steam into the an oil bearing deposit through a first well, and recovering secondary and tertiary values from the deposit, preferably through a second well.

DETAILED DESCRIPTION OF THE PREFERRED EMBODIMENTS

Figure 1:
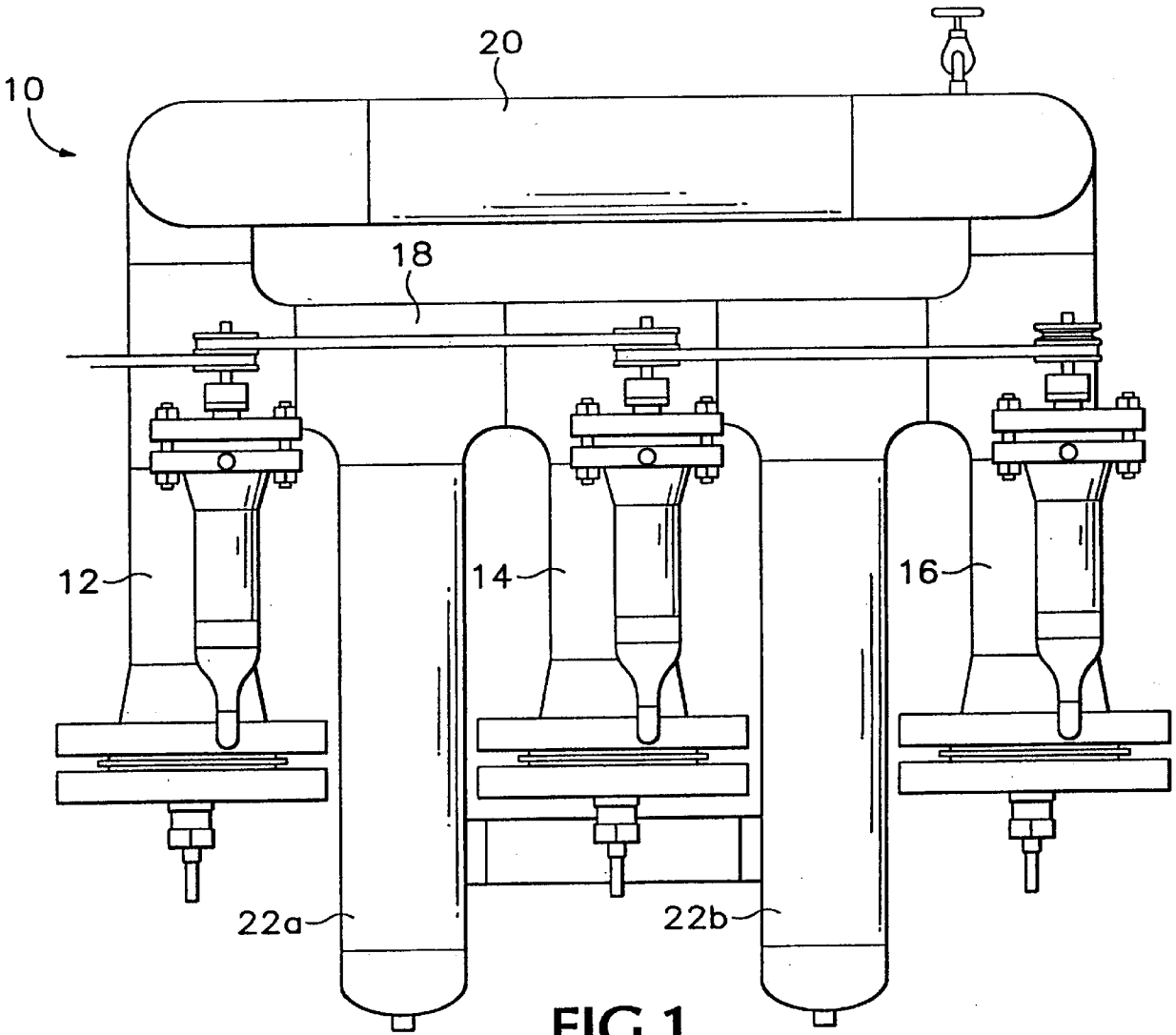
FIG. 1 is a front elevational view of a first embodiment of the invention.
Figure 2:
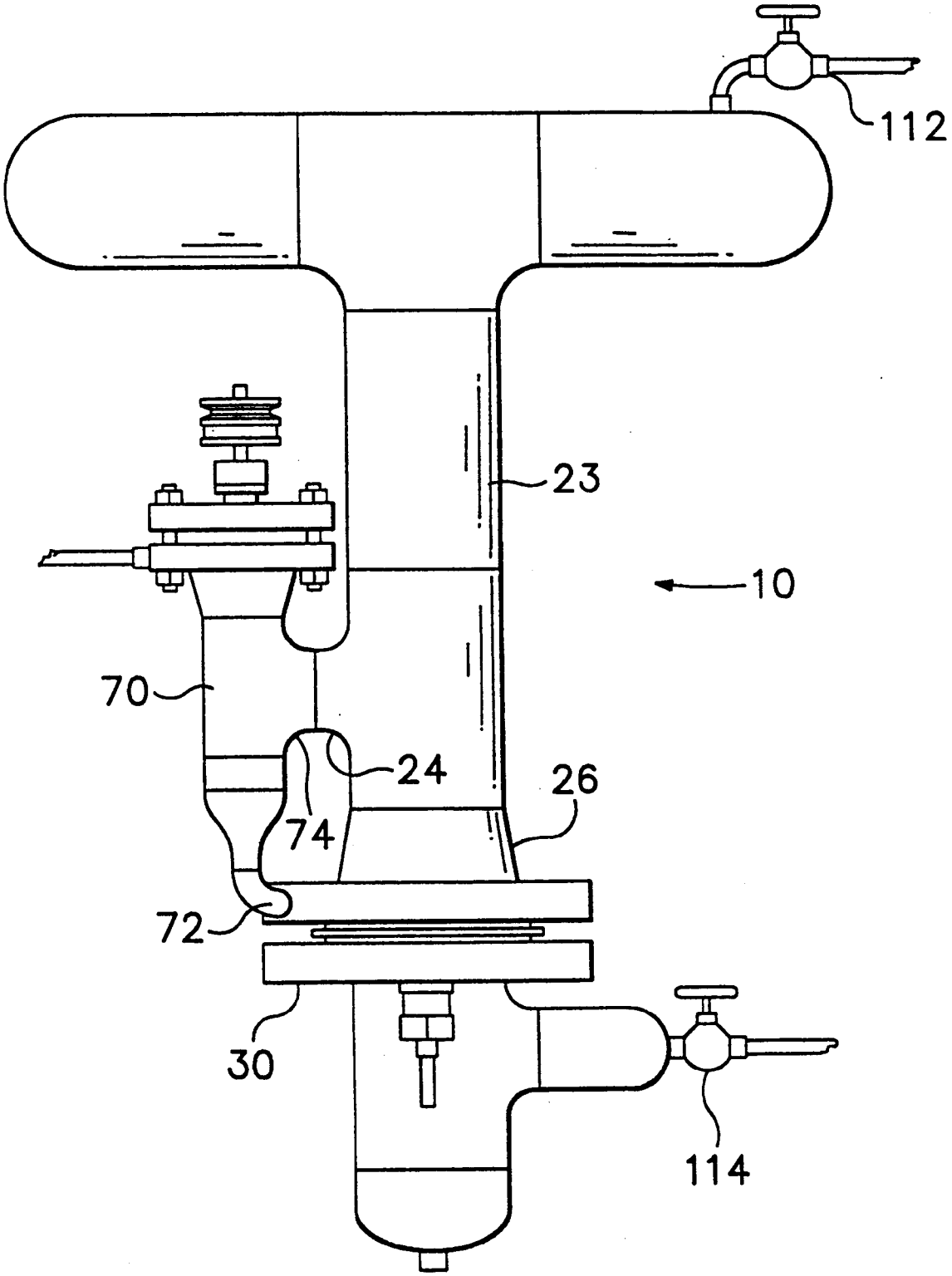
FIG. 2 is a side elevational view of the embodiment shown in FIG. 1.

Referring now to the drawings, a reaction vessel according to the present invention is shown generally at 10 in FIGS. 1 and 2. Vessel 10 comprises three similar reaction chambers 12, 14 and 16, which are connected at their upper ends to manifold 18. Manifold 18 is connected at each end to a gas collection header 20, and to a liquid trap 22. As best seen in FIG. 2, each of reaction chambers 12, 14 and 16 comprises a vertical cylindrical chamber 23. Chamber 23 has an inlet 24, an upper outlet 25, and a lower outlet 27. Upper outlet 25 is welded to manifold 18, and lower outlet 27 is welded to an electrode housing 26.

Figure 3:
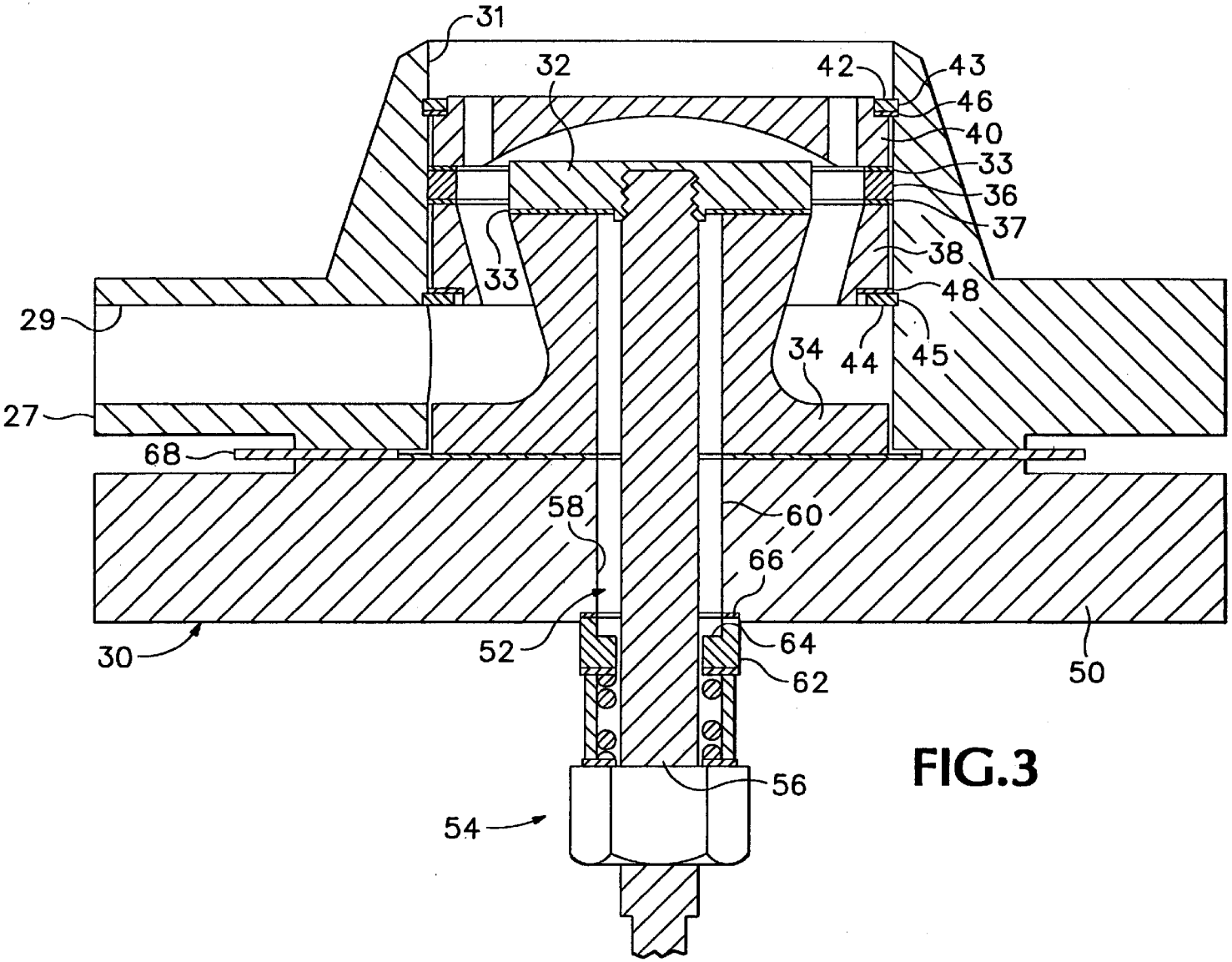
FIG. 3 is partial cross-sectional view of the embodiment shown in claim 1, showing the electrode assembly in greater detail.
Figure 4A:
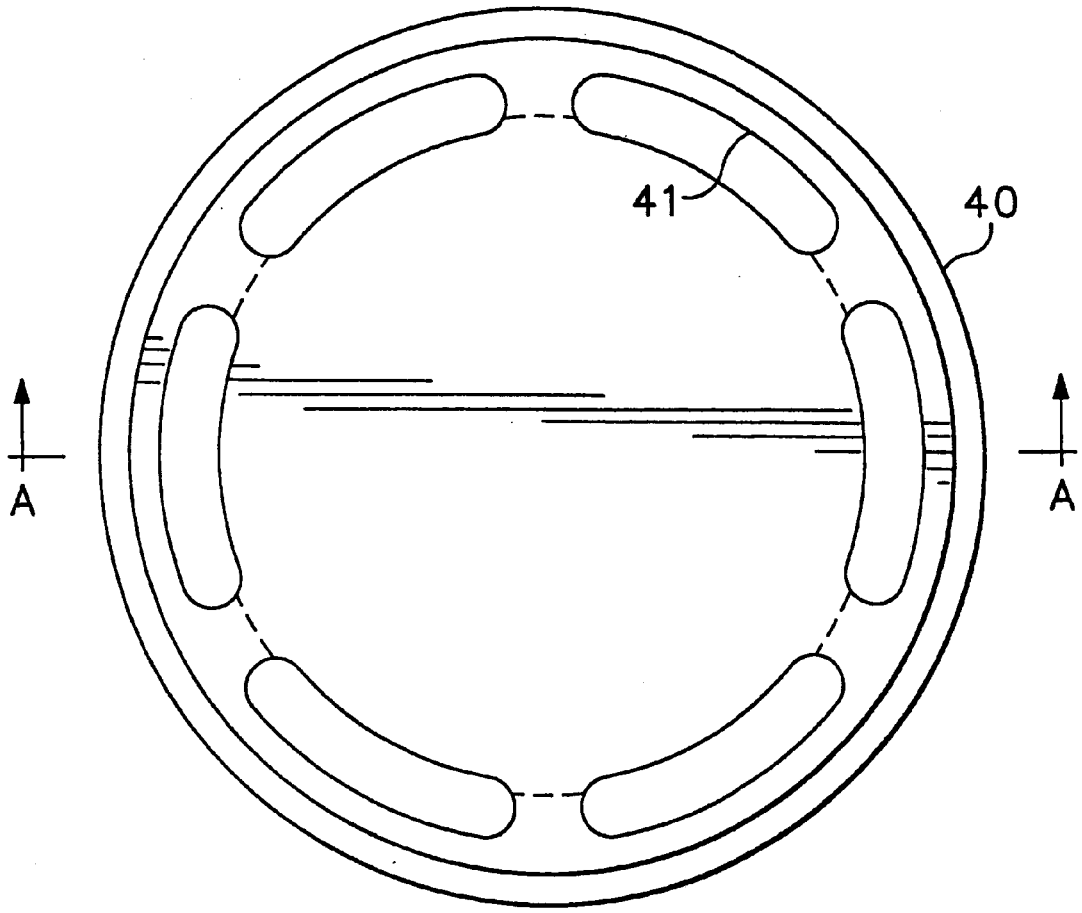
FIG. 4A is cross-sectional view of liquid distributor through line A—A in FIG.3.
Figure 4B:
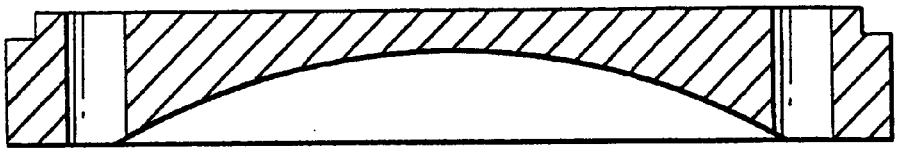
FIG. 4B is side view of the liquid distributor shown in FIG. 4A.
Figure 6:
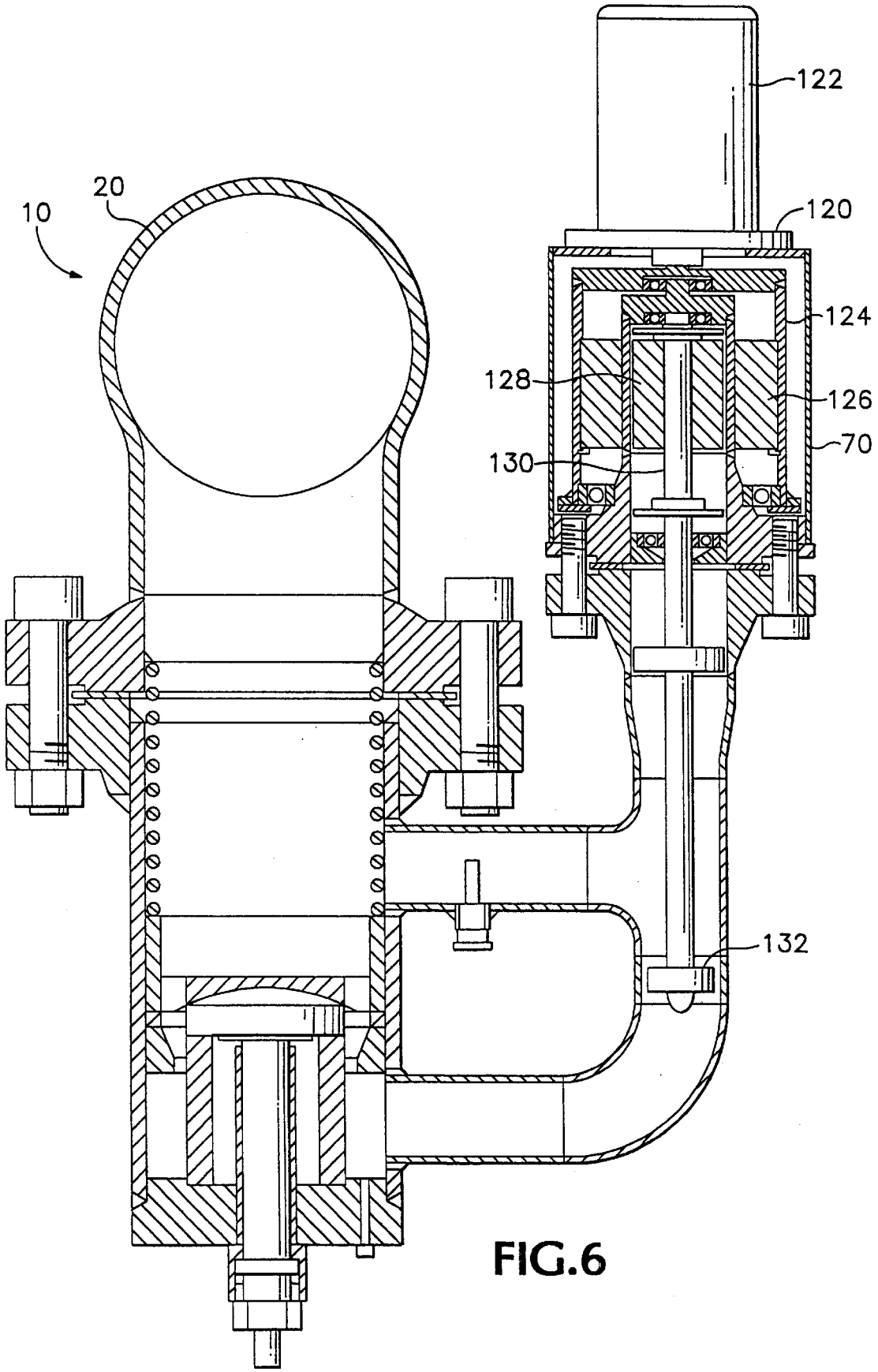
FIG. 6 is a side elevational view of a second embodiment of the pump and which has a magnetic drive.

As best seen by reference to FIG. 3, electrode housing assembly 26 includes flanged member 27 having a lateral bore 29 which communicates with a vertical bore 31, which has the same diameter as chamber 23, extending through the housing. Within bore 31, a ring-shaped grounding electrode 36 is supported atop a support 38, and is in electrical contact with the inner wall of electrode housing 26. A distributor plate 40 is fitted atop grounding electrode 36. Referring to FIGS. 4A and 4B, 6 vertical ports 41 are spaced evenly around the periphery of plate 40, and extend therethrough. In the preferred embodiment, the ports are one-half inch wide, and spaced apart one-half inch. The number, size and spacing of the ports could be varied to accommodate variations in the size or liquid-flow capacity of the apparatus.

Gaskets 33 and 37 cushion the grounding electrode 36. Circlips 42 and 44, fitted in grooves 43 and 45 respectively, fix annular member 38, ring member 40 and grounding electrode 36 in place in electrode housing 26. Circlips 42 and 44 are each electrically isolated from the adjacent members by gaskets 46 and 48 respectively. The foregoing components are assembled in electrode housing 26 by first inserting circlip 42 into groove 43, and then fitting, in order, ported distributor ring 40, gasket 37, grounding electrode 36, gasket 33, member 38, gasket 48, and circlip 44.

Thus assembled, electrode housing assembly 26 is configured to receive flange assembly 30. Flange assembly 30 comprises a flange member 50, an electrode assembly 52, and a retainer assembly 54. Electrode assembly 52 includes a central, disk-shaped electrode 32 which is supported atop a gasket 33 and a support member 34. Electrode 32 is connected to an AC-electrical source through bus bar 56. Bus bar 56 extends through bore 58 and bushing 60, and is threaded into central electrode 32. Bushing 60 electrically isolates bus bar 56, and also seals against leakage past the bus bar. Bushing 60 is fixed in place by retainer assembly 54, and is preferably made from a ceramic material, although any insulative material capable of withstanding the operating conditions described below could be used.

Retainer assembly 54 includes an electrically insulative collar 62 having a shoulder 64 which bears against the lower end of bushing 60. Gasket 66 is fitted between collar 62 and the flange 31.

Flange assembly 30 is bolted to electrode housing 26, with gasket 68 in between. When flange assembly 30 and electrode housing 26 form a fluid flow path from the top opening of electrode housing 26, through the ports in the distributor plate 40, between electrode 32 and grounding electrode 36, and between members 34 and 38 into port 29.

Figure 5:
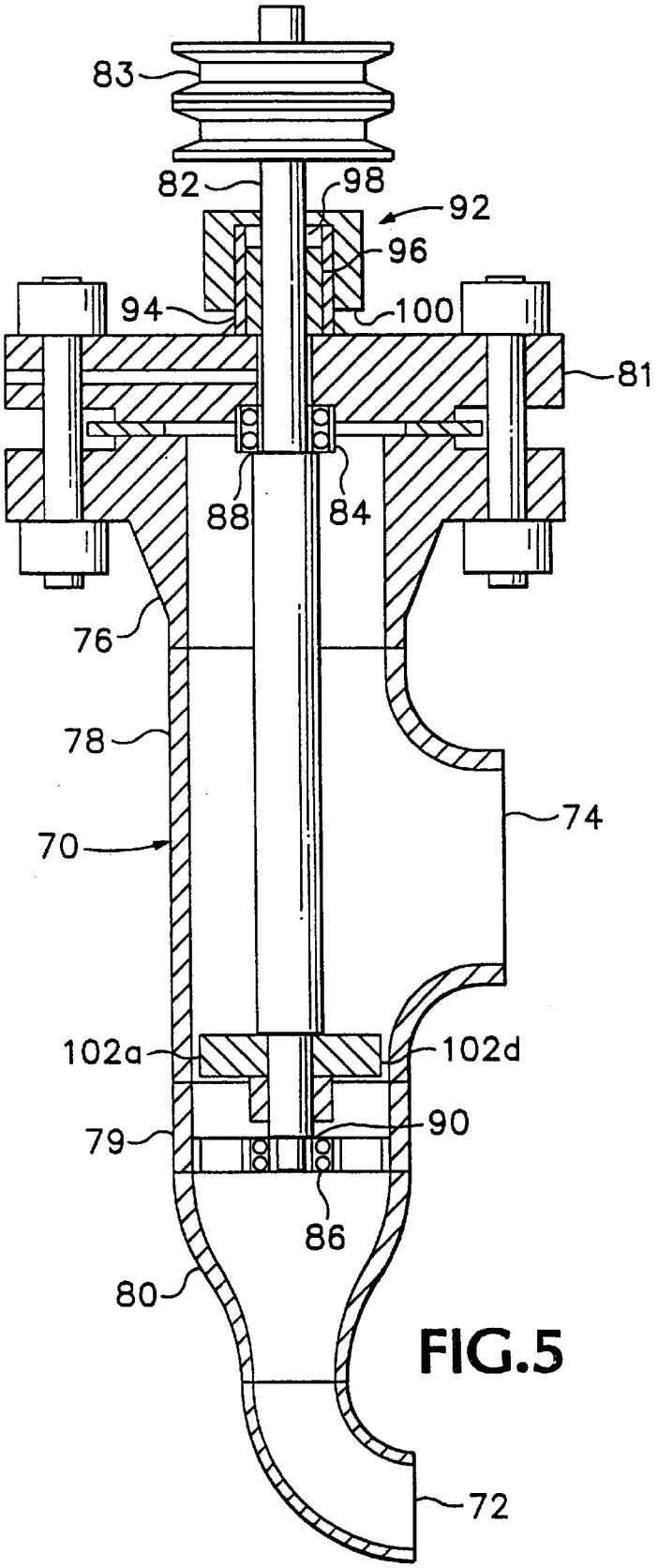
FIG. 5 is a cross-sectional view of a first embodiment of the brine pump.

Referring again to FIG. 2, a circulating pump is shown at 70. The circulating pump inlet 72 is connected to flange assembly 30 and communicates with port 29. Circulating pump outlet 74 is connected to inlet 24 to chamber 23. Turning to FIG. 5, circulating pump 70 is shown in greater detail. The pump body is assembled from steel weld fittings, including a flanged nipple 76, a tee 78, a short nipple 79, and a reducer 80. End flange 81 is bolted to flanged nipple 76. Shaft 82 is mounted in the pump body and extends upwardly through flange 81. A drive sheave 83 is mounted on shaft 82 above flange 81. Angled blades 102*a–d* are affixed to shaft 82 near its lower end. Shaft 82 is located radially and axially in the pump housing by upper bearing 84 and lower bearing 86, which engage shoulders 88 and 90 respectively. Bearings 84 and 86 are combination thrust and radial bearings. Shaft 82 is sealed at flange 81 by a packing gland 92. Packing gland 92 includes a nipple 94 having a threaded upper end. A suitable packing material 96 is inserted into nipple 94 around shaft 82, and a bushing 98 is fitted into nipple 94 atop the packing material. Gland nut 100 is threaded onto the upper end of nipple 94 and urges bushing 98 downwardly, compressing the packing material 96 against shaft 82. In the embodiment shown in FIG. 1, pumps 70*a*, 70*b*, and 70*c* are fitted with a double drive sheaves 83*a–c* respectively. Drive belt 106 is engaged with an electric motor (not shown) and sheave 83*a*. Belt 108 is engaged with sheaves 83*a* and 83*b*, and belt 110 is engaged with sheaves 83*b* and 83*c*. This arrangement permits pumps 70*a–c* to be driven by the single electric motor.

Figure 7:
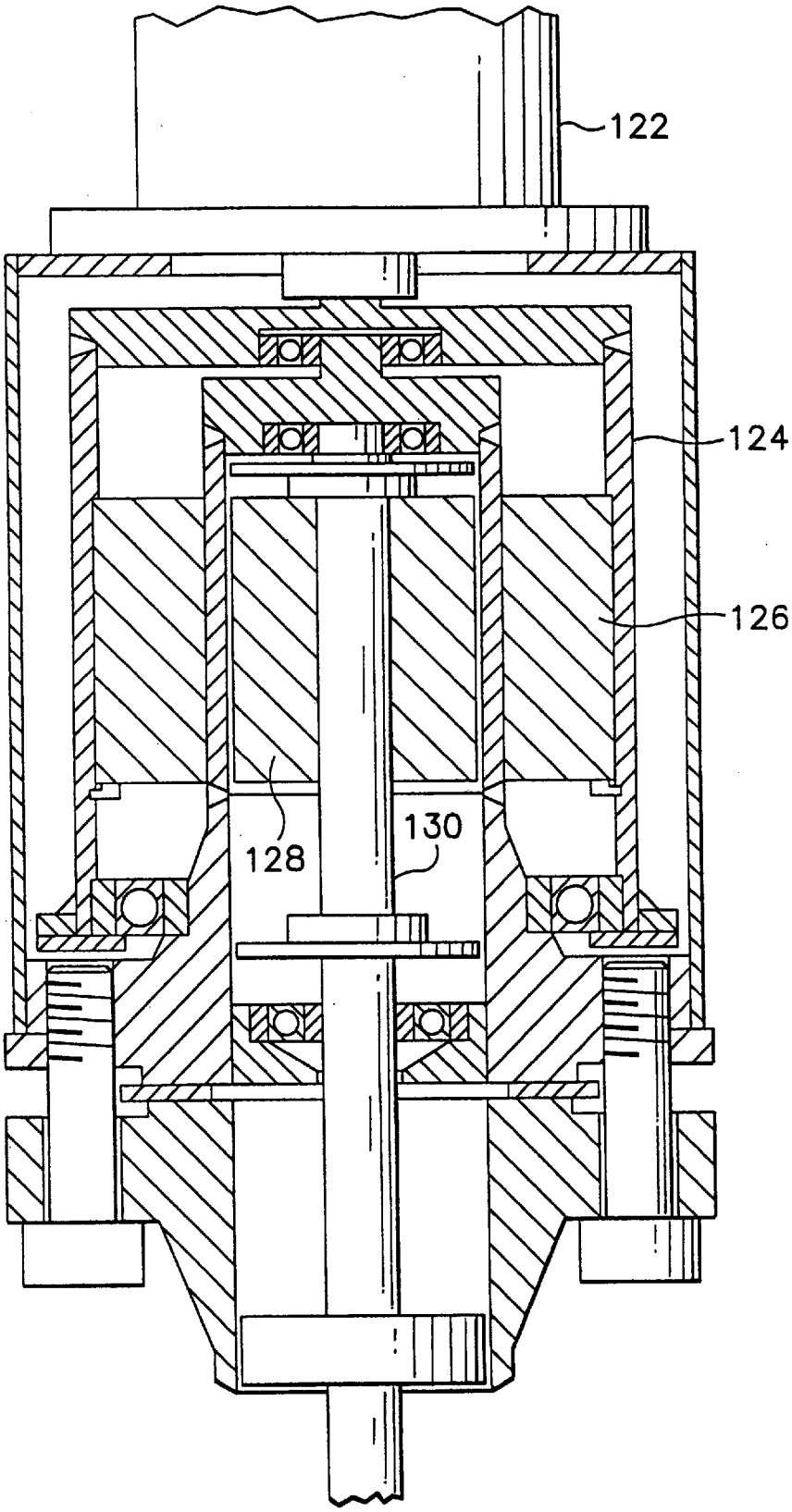
FIG. 7 is a partial cutaway view of the pump shown in FIG. 6.

In an alternate embodiment shown in FIGS. 6 and 7, the belt and sheave drive mechanism of pump 70 may be replaced with a magnetic drive unit 120. In the embodiment shown, motor 122 drives rotor 124, on which is mounted magnets 126. As magnets 126 are rotated, their magnetic interaction with magnets 128 mounted on shaft 130 rotate shaft 130 and impeller 132.

Referring to FIGS. 2–4, the operation of the invention will now be described. In general, the apparatus operates to generate a mixture of water and hydrogen gas for injection into a well to enhance secondary or tertiary recovery from an oil-bearing formation. In one embodiment, vessel 10 is charged with 2–10 gallons per minute of brine solution at 540° F. and 1250 psi, and which has a salinity of 10,000 to 15,000 ppm. 5–6 drops of oil per second is added to the brine solution. Referring to FIGS. 2 and 3, pump 70 circulates brine through chamber 23 and between electrodes 32 and 36. Vessel 10 and pump 70 are sized to provide a high recycle rate, which in addition to helping heat the brine mixture, provides a higher fluid velocity past the electrodes and wipes gas from the electrode surface. At the same time an alternating current is being discharged between the electrodes through the circulating brine. In one embodiment, electrodes 32 and 36 are spaced apart approximately ⅞ of an inch, and are connected to an ac source having a voltage between 250–300 volts. Current is optimally discharged from the electrodes is between 40 and 60 amps/in$^2$. In one embodiment, 500 amps of alternating current is discharged through the electrodes at 277 volts. Electrodes 32 and 36 are sized so that the current is discharged from the electrodes at 60 amps/in$^2$. As the brine passes between electrodes 32 and 36, the current flow cleaves a portion of the water to form hydrogen gas, which is collected in gas collection header 20 and then discharged to the well through exhaust gas valve 112. A brine stream, which might also contain entrained or dissolved hydrogen gas and gaseous hydrocarbons, is discharged through brine discharge valve 114. Make-up brine is injected into the apparatus at a rate of 2–10 gallons per minute through brine inlet 120. In one embodiment, oil is added to the make up brine at the rate of 5–6 drops per second. The discharged hydrogen gas and brine streams can be injected into a well separately, or as a combined stream, according to known methods. In another embodiment, the pressure of the brine-hydrogen mixture is adjusted or maintained so that a portion of the brine is converted to steam, and the resulting hydrogen, brine and steam mixture is introduced into the formation. The pressure is preferably controlled by either controlling the pressure of the brine fed to the mixing chamber, or by providing a pressure control valve on the well head or on a pipe in communication with the well head. Suitable pressure control valves are well-known to those familiar with the design and construction of well head assemblies. It is also deemed within the scope of the invention where the pressure of the mixture is reduced by the head losses incurred along the length of process piping "downstream" of the mixing chamber, in the well itself, or at the exit of the injection well.

The operation of the invention is further demonstrated by the following examples.

EXAMPLE 1

A hydrogen generator as shown in FIGS. 1–3 was initially purged by being charged with nitrogen at 325 psi. Each 8" diameter reaction chamber 23 was charged with 1250 psi, 540° F. brine at a rate of approximately 4 gallons per minute. The brine had a salinity of 10,000–15,000 ppm. Oil was added to each incoming brine stream at the rate of 2 drops per second. The brine was circulated through each reaction chamber by its respective circulating pump at the rate of 10–20 gallons per minute. Electrodes 32 and 36, which were spaced ⅞" apart, discharged 500 amps of alternating current at 277 volts through the brine as it flowed between the electrodes. Steady state operation was achieved after 20 minutes of operation, and was maintained for 3 hours. During that period, the hydrogen generator produced hydrogen and other gases at 1250 psi and 540° F. Additional fresh brine was added at liquid trap 22*a* to reduce the temperature of the mixture to below the boiling point of the formation fluids at formation pressures. The formation pressure was increased from <20 psi to as high as 250 psi.

EXAMPLE 2

A hydrogen generator as shown in FIGS. 1–3 was fitted to the head of an injection well in an actively producing oil field, which included both producing and dormant wells. The hydrogen generator of FIGS. 1–3 was initially purged by being charged with nitrogen at 325 psi. Each reaction chamber 23 was charged with brine at 505 psi. The brine had a salinity of 10,000–15,000 ppm. The brine was circulated through each reaction chamber by its respective circulating pump. 460–680 amps of alternating current at 250–280 volts was applied to electrodes 32 and 36, which were spaced ⅞" apart. Each reaction chamber reached was thus heated to between 540–560° F. Oil was added to each incoming brine stream at the rate of 2 drops per second. The heated brine and gas mixture was then injected down the well intermittently for 9 hours over each of the next three days. Injection time on each of these days totaled 2–4 hours. At that time, the unit experienced operating problems, and was removed from the injection well head. About one week later, a well approximately 600 feet away, and which until then had been dormant for about 7 years, blew out. Two days later, a second, previously dormant well, this one about 1000 feet from the injection well, released gas from the its relief valve. Two days after that, a producing well approximately 1300 feet from the injection well doubled its production from ½ barrel per day to approximately 1 barrel per day.

EXAMPLE 3

A hydrogen generator as shown in FIGS. 1–3 is fitted to the head of an injection well in an actively producing oil field, which includes both producing and dormant wells. The hydrogen generator of FIGS. 1–3 is initially purged by being charged with nitrogen at 325 psi. Each reaction chamber 23 is charged with brine at 505 psi. The brine has a salinity of 10,000–15,000 ppm. The brine is circulated through each reaction chamber by its respective circulating pump. 460–680 amps of alternating current at 250–280 volts is applied to electrodes 32 and 36, which are spaced ⅞" apart. Each reaction chamber reached is thus heated to between 540–560° F. Oil is added to each incoming brine stream at the rate of 2 drops per second. The pressure of the heated brine and gas mixture is then reduced sufficiently to cause a portion of the brine to steam. The resulting mixture is injected into the formation intermittently for 9 hours over each of the next three days. Injection time on each of these days totals 2–4 hours. Several days to two weeks later secondary and tertiary values are recovered from one or more wells separated from the first well by about 100 to several thousand feet.

The foregoing description and examples are intended to illustrate rather than limit the scope of the claimed invention.

I claim:

1. A method for recovering petroleum from an underground formation penetrated by a first well and a second well:

injecting hydrogen and hot water into the formation via the first well;

increasing the formation pressure at the second well; and recovering hydrocarbon fluids from said formation via the second well.

2. The method of claim 1 wherein said method further includes the step of injecting hydrogen and hot water into the second well and shutting in the second well prior to the step of injecting hydrogen and hot water into the formation via the first well.

3. The method of claim 2 wherein the step of injecting hydrogen and hot water into the second well is performed after the step of injecting hydrogen and hot water into the formation via the first well.

4. The method of claim 1 wherein the step of injecting hydrogen and hot water into the formation via the first well includes the step of injecting a sufficient amount of hydrogen to cause an increase in the volume of petroleum in the formation.

5. The method of claim 4 wherein said method further includes the step of injecting the hydrogen at a pressure of substantially less than or equal to one pound per square foot per foot of well depth through which the hydrogen enters the formation.

6. The method of claim 4 wherein said method further includes the step of maintaining the temperature of the water just below the boiling point.

7. The method of claim 6 wherein said method further includes the step of injecting the hydrogen, hot water and steam in the form of a mist.

8. The method of claim 7 wherein said method further includes the step of mixing oil with the mist prior to the step of injecting the mist.

9. The method of claim 8 wherein said hydrogen is formed by passing the hot water and oil drop mist between a pair of alternating current electrodes prior to the step of injecting the hydrogen, hot water and steam.

10. The method of claim 1 which further comprises the steps of:

shutting in the first well;

injecting hydrogen, hot water and steam into the formation via the second well;

monitoring formation pressure at the first well until a predetermined pressure increase is detected; and recovering hydrocarbon fluids from said formation via the first well.

11. The method of claim 1 wherein the water is a brine.

12. A well head assembly comprising:

a well head;

a body having a mixing chamber;

a pair of spaced apart electrodes disposed within the mixing chamber;

a liquid inlet communicating with the mixing chamber;

a first gas outlet communicating with the mixing chamber;

a second outlet in communication with the mixing chamber and the well head;

a pump in communication with the mixing chamber for circulating liquid contained in the mixing chamber between the electrodes; and, a pressure controller in communication with the well head.

13. The well head assembly of claim 12 wherein the means for passing a liquid between the electrodes comprises a liquid circulating pump communicating with the mixing chamber.

14. The well head assembly of claim 12 wherein the liquid inlet is in communication with a source of water.

15. The well head assembly of claim 14 wherein the source of water comprises a source of heated brine.

16. The well head assembly of claim 12 wherein the liquid inlet includes means for introducing a carbon-containing material into the mixing chamber.

17. The well head assembly of claim 16 wherein the carbon-containing material comprises a hydrocarbon.

18. The well head assembly of claim 17 wherein the carbon-containing material comprises a liquid hydrocarbon.

19. The well head assembly of claim 12 wherein the electrodes are in electrical communication with an alternating current source.

20. The well head assembly of claim 12 wherein the electrodes are spaced apart between one-half an inch and three inches.

21. A method for recovering petroleum from an underground formation penetrated by a first well and a second well:

injecting hydrogen, hot water and steam into the formation via the first well;

increasing the formation pressure at the second well; and recovering hydrocarbon fluids from said formation via the second well.

22. The method of claim 21 wherein said method further includes the step of injecting hydrogen, hot water and steam into the second well and shutting in the second well, prior to the step of injecting hydrogen, hot water and steam into the formation via the first well.

23. The method of claim 22 wherein the step of injecting hydrogen, hot water and steam into the second well is performed after the step of injecting hydrogen, hot water and steam into the formation via the first well.

24. The method of claim 23 wherein the step of injecting hydrogen, hot water and steam into the formation via the first well includes the step of injecting a sufficient amount of hydrogen to cause an increase in the volume of petroleum in the formation.

25. The method of claim 24 wherein said method further includes the step of injecting the hydrogen at a pressure of substantially less than or equal to one pound per square foot per foot of well depth through which the hydrogen enters the formation.

26. The method of claim 24 wherein said method further includes the step of maintaining the temperature of the hot water just below the boiling point.

27. The method of claim 26 wherein said method further includes the step of injecting the hydrogen, hot water and steam in the form of a mist.

28. The method of claim 27 wherein said method further includes the step of mixing oil with the mist prior to the step of injecting the mist.

29. The method of claim 28 wherein said hydrogen is formed by passing the hot water and oil drop mist between a pair of alternating current electrodes prior to the step of injecting the hydrogen, hot water and steam.

30. The method of claim 28 wherein the hot water is a brine.

* * * * *